US008194012B2

(12) United States Patent
Choi

(10) Patent No.: US 8,194,012 B2
(45) **Date of Patent: *Jun. 5, 2012**

(54) PIXEL AND ORGANIC LIGHT EMITTING DISPLAY USING THE SAME

(75) Inventor: Sang-Moo Choi, Suwon-si (KR)

(73) Assignee: Samsung Mobile Display Co.,Ltd., Yongin (KR)

( * ) Notice: Subject to any disclaimer, the term of this patent is extended or adjusted under 35 U.S.C. 154(b) by 700 days.

This patent is subject to a terminal disclaimer.

(21) Appl. No.: 12/343,320

(22) Filed: Dec. 23, 2008

(65) Prior Publication Data

US 2009/0225011 A1 Sep. 10, 2009

(30) Foreign Application Priority Data

Mar. 10, 2008 (KR) ..... 10-2008-0021974

(51) Int. Cl.
*G09G 3/30* (2006.01)

(52) U.S. Cl. ..... 345/77

(58) Field of Classification Search ..... None
See application file for complete search history.

(56) References Cited

U.S. PATENT DOCUMENTS

| | | | |
|---|---|---|---|
| 7,310,078 | B2 | 12/2007 | Kim |
| 7,339,562 | B2 | 3/2008 | Ikeda |
| 7,365,742 | B2 | 4/2008 | Kim et al. |
| 7,414,599 | B2 | 8/2008 | Chung et al. |
| 7,443,366 | B2 | 10/2008 | Choi et al. |
| 8,054,258 | B2 | 11/2011 | Choi et al. |
| 2004/0174354 | A1 | 9/2004 | Ono et al. |
| 2005/0099412 | A1 | 5/2005 | Kasai |
| 2005/0140600 | A1 | 6/2005 | Kim et al. |
| 2005/0200575 | A1 | 9/2005 | Kim et al. |
| 2005/0269958 | A1 | 12/2005 | Choi et al. |

(Continued)

FOREIGN PATENT DOCUMENTS

CN 1601594 A 3/2005

(Continued)

OTHER PUBLICATIONS

KIPO Office action dated Sep. 29, 2009, for priority Korean application 10-2008-0021974, noting listed references in this IDS.

(Continued)

*Primary Examiner* — Joseph Feild
*Assistant Examiner* — Henok Heyi
(74) *Attorney, Agent, or Firm* — Christie, Parker & Hale, LLP

(57) ABSTRACT

A pixel capable for compensating for the degradation of an organic light emitting diode. The pixel includes an organic light emitting diode; a pixel circuit including a driving transistor for controlling an electric current capacity flowing from a first power source to a second power source via the organic light emitting diode; and a compensation unit for controlling a voltage of a gate electrode of the driving transistor to correspond to a degradation of the organic light emitting diode. The compensation unit includes first and second feedback capacitors coupled in series between an anode electrode of the organic light emitting diode and the gate electrode of the driving transistor and a switching transistor coupled between a common node of the first and second feedback capacitors and a reset power source and for turning on when a control signal is supplied to a control line coupled to the switching electrode.

19 Claims, 5 Drawing Sheets

U.S. PATENT DOCUMENTS

| | | | | |
|---|---|---|---|---|
| 2005/0275607 | A1 | 12/2005 | Tobita | |
| 2005/0280614 | A1 | 12/2005 | Goh | |
| 2006/0012549 | A1 | 1/2006 | Ikeda | |
| 2006/0022305 | A1 | 2/2006 | Yamashita | |
| 2006/0023551 | A1 | 2/2006 | Peng et al. | |
| 2006/0038754 | A1 | 2/2006 | Kim | |
| 2006/0066526 | A1 | 3/2006 | Kim et al. | |
| 2006/0066528 | A1 | 3/2006 | Hara | |
| 2006/0103324 | A1 | 5/2006 | Kim et al. | |
| 2006/0145964 | A1 | 7/2006 | Park et al. | |
| 2006/0145967 | A1 | 7/2006 | Huh | |
| 2006/0152449 | A1 | 7/2006 | Norimatu | |
| 2006/0208971 | A1 | 9/2006 | Deane | |
| 2006/0253755 | A1 | 11/2006 | Wu | |
| 2007/0046593 | A1 * | 3/2007 | Shin | 345/81 |
| 2008/0111804 | A1 * | 5/2008 | Choi et al. | 345/205 |
| 2008/0211397 | A1 * | 9/2008 | Choi | 313/504 |
| 2008/0224965 | A1 * | 9/2008 | Kim | 345/76 |

FOREIGN PATENT DOCUMENTS

| | | | |
|---|---|---|---|
| CN | 1677470 | A | 10/2005 |
| CN | 1728219 | A | 2/2006 |
| EP | 1 130 565 | A1 | 9/2001 |
| EP | 1 496 495 | A2 | 1/2005 |
| EP | 1 496 495 | A8 | 3/2005 |
| EP | 1 585 100 | A1 | 10/2005 |
| EP | 1 496 495 | A3 | 5/2007 |
| EP | 1 968 039 | A1 | 9/2008 |
| EP | 1 970 885 | A1 | 9/2008 |
| JP | 06-266313 | | 9/1994 |
| JP | 2003-263129 | | 9/2003 |
| JP | 2005-189695 | | 7/2005 |
| JP | 2005-202255 | | 7/2005 |
| JP | 2005-520191 | T | 7/2005 |
| JP | 2005-308868 | | 11/2005 |
| JP | 2006-38963 | | 2/2006 |
| JP | 2006-038965 | | 2/2006 |
| JP | 2006-53539 | | 2/2006 |
| JP | 2006-138953 | | 6/2006 |
| JP | 2006-146219 | | 6/2006 |
| JP | 2006-243526 | | 9/2006 |
| JP | 2006-251632 | | 9/2006 |
| JP | 2006-276253 | | 10/2006 |
| JP | 2006-309179 | | 11/2006 |
| JP | 2007-206590 | | 8/2007 |
| JP | 2008-39946 | | 2/2008 |
| JP | 2008-122906 | | 5/2008 |
| KR | 10-2002-0054850 | | 7/2002 |
| KR | 2003-0081919 | | 10/2003 |
| KR | 10-2004-0008922 | | 1/2004 |
| KR | 10-2005-0005646 | | 1/2005 |
| KR | 10-2005-0045814 | | 5/2005 |
| KR | 10-2005-0051300 | | 6/2005 |
| KR | 10-2005-0098485 | | 10/2005 |
| KR | 10-2005-0116206 | | 12/2005 |
| KR | 10-2005-0121379 | | 12/2005 |
| KR | 10-2005-0123328 | | 12/2005 |
| KR | 10-2006-0020502 | | 3/2006 |
| KR | 10-2006-0028021 | | 3/2006 |
| KR | 10-2006-0029088 | | 4/2006 |
| KR | 10-2006-0033376 | | 4/2006 |
| KR | 10-2006-0046352 | | 5/2006 |
| KR | 10-2006-0048834 | | 5/2006 |
| KR | 10-2006-0048924 | | 5/2006 |
| KR | 10-2006-0054603 | | 5/2006 |
| KR | 10-2006-0071679 | | 6/2006 |
| KR | 10-0623919 | | 9/2006 |
| KR | 10-2007-0012979 | | 1/2007 |
| KR | 10-2007-0092742 | | 9/2007 |
| KR | 10-2008-0000925 | | 1/2008 |
| KR | 10-2008-0056923 | | 6/2008 |

OTHER PUBLICATIONS

Office Action dated Oct. 19, 2010 for related U.S. Appl. No. 11/984,024, filed Nov. 13, 2007 (now U.S. Patent No. 8,054,258, issued Nov. 8, 2011), 8 pages.

Office Action dated Apr. 28, 2011 for related U.S. Appl. No. 11/984,024, filed Nov. 13, 2007 (now U.S. Patent No. 8,054,258, issued Nov. 8, 2011), 10 pages.

Notice of Allowance dated Sep. 9, 2011 for related U.S. Appl. No. 11/984,024, filed Nov. 13, 2007 (now U.S. Patent No. 8,054,258, issued Nov. 8, 2011), 5 pages.

Choi, S.M., et al., *A Self-compensated Voltage Programming Pixel Structure for Active-Matrix Organic Light Emitting Diodes*, IDW'03, (2003), pp. 535-538, XP 08057381.

U.S. Office action dated Apr. 13, 2011, for cross reference U.S. Appl. No. 12/081,105, 19 pages.

U.S. Office action dated Sep. 14, 2011, for cross reference U.S. Appl. No. 12/081,105, 11 pages.

SIPO Patent Gazette dated Dec. 15, 2010, for Chinese Patent application 200810091613.5, 3 pages.

* cited by examiner

PIXEL AND ORGANIC LIGHT EMITTING DISPLAY USING THE SAME

CROSS-REFERENCE TO RELATED APPLICATIONS

This application claims priority to and the benefit of Korean Patent Application No. 10-2008-0021974, filed on Mar. 10, 2008, in the Korean Intellectual Property Office, the entire content of which is incorporated herein by reference.

BACKGROUND OF THE INVENTION

1. Field of the Invention

The present invention relates to a pixel and an organic light emitting display using the same, and more particularly to a pixel capable of compensating for the degradation of an organic light emitting diode, and an organic light emitting display using the same.

2. Description of Related Art

In recent years, there have been many attempts to develop various flat panel displays having a lighter weight and a smaller volume than that that of a cathode ray tube display. The flat panel displays include a liquid crystal display (LCD), a field emission display (FED), a plasma display panel (PDP), an organic light emitting display (OLED), etc.

Amongst the flat panel displays, the organic light emitting display displays an image by using an organic light emitting diode which generates light by utilizing the recombination of electrons and holes. Such an organic light emitting display has an advantage that it has a rapid response time and may be driven with low power consumption.

FIG. 1 is a circuit diagram schematically showing a pixel 4 of a conventional organic light emitting display.

Referring to FIG. 1, the pixel 4 of the conventional organic light emitting display includes an organic light emitting diode (OLED) and a pixel circuit 2 coupled to a data line (Dm) and a scan line (Sn) to control the organic light emitting diode (OLED).

An anode electrode of the organic light emitting diode (OLED) is coupled to the pixel circuit 2, and a cathode electrode is coupled to the second power source (ELVSS). Such an organic light emitting diode (OLED) generates the light with set (or predetermined) luminance to correspond to an electric current supplied from the pixel circuit 2.

The pixel circuit 2 controls an electric current capacity supplied to the organic light emitting diode (OLED) to correspond to a data signal supplied to the data line (Dm) when a scan signal is supplied to the scan line (Sn). For this purpose, the pixel circuit 2 includes a second transistor (M2) coupled between the first power source (ELVDD) and the organic light emitting diode (OLED); a first transistor (M1) coupled between the second transistor (M2), and the data line (Dm) and the scan line (Sn); and a storage capacitor (Cst) coupled between a gate electrode of the second transistor (M2) and a first electrode of the second transistor (M2).

A gate electrode of the first transistor (M1) is coupled to the scan line (Sn), and a first electrode of the first transistor (M1) is coupled to the data line (Dm). And, a second electrode of the first transistor (M1) is coupled to one side terminal of the storage capacitor (Cst). Here, the first electrode of the first transistor (M1) is set to be a source electrode or a drain electrode, and the second electrode is set to be the other electrode that is different from the first electrode. For example, when the first electrode is set to be a source electrode, the second electrode is set to be a drain electrode. The first transistor (M1), coupled to the scan line (Sn) and the data line (Dm), is turned on when a scan signal is supplied to the scan line (Sn), thereby supplying a data signal, supplied from the data line (Dm), to the storage capacitor (Cst). At this time, the storage capacitor (Cst) is charged with a voltage corresponding to the data signal.

The gate electrode of the second transistor (M2) is coupled to one side terminal of the storage capacitor (Cst), and the first electrode of the second transistor (M2) is coupled to the other side terminal of the storage capacitor (Cst) and the first power source (ELVDD). A second electrode of the second transistor (M2) is coupled to an anode electrode of the organic light emitting diode (OLED). Such a second transistor (M2) controls an electric current capacity to correspond to the voltage value stored in the storage capacitor (Cst), the electric current capacity flowing from the first power source (ELVDD) to the second power source (ELVSS) via the organic light emitting diode (OLED). At this time, the organic light emitting diode (OLED) generates light corresponding to the electric current capacity supplied from the second transistor (M2).

However, the above-mentioned organic light emitting display has a problem in that it is difficult to display an image with desired luminance due to the changes in efficiency caused by the degradation (or deterioration) of the organic light emitting diode (OLED). That is, the organic light emitting diode (OLED) degrades with time, and therefore it is difficult to display the image with the desired luminance over time because the organic light emitting diode (OLED) with more degradation generates light with lower luminance than that of an organic light emitting diode (OLED) with less degradation.

SUMMARY OF THE INVENTION

An aspect of an embodiment of the present invention is directed toward a pixel capable of compensating for the degradation of an organic light emitting diode.

Another aspect of an embodiment of the present invention is directed toward an organic light emitting display using the pixel.

An embodiment of the present invention provides a pixel including an organic light emitting diode; a second transistor for controlling an electric current capacity flowing from a first power source to a second power source via the organic light emitting diode; a first capacitor coupled between a gate electrode of the second transistor and a power line or a control line; a first transistor coupled to a scan line and a data line and for turning on, when a scan signal is supplied to a scan line, to supply a data signal, supplied by the data line, to the gate electrode of the second transistor; and a compensation unit for controlling a voltage of the gate electrode of the second transistor to correspond to a degradation of the organic light emitting diode. The compensation unit includes first and second feedback capacitors coupled in series between an anode electrode of the organic light emitting diode and the gate electrode of the second transistor and a third transistor coupled between a common node of the first and second feedback capacitors and a reset power source and for turning on when a control signal is supplied to the control line.

The pixel according to one embodiment of the present invention further includes a fourth transistor coupled between the second transistor and the organic light emitting diode and for turning off when a light emitting control signal is supplied to a light emitting control line. Also, the pixel according to one embodiment of the present invention further includes a second capacitor coupled between the gate electrode of the second transistor and the first power source. Furthermore, the reset power source may be set to have substantially identical voltage as that of the first power source.

Another embodiment of the present invention provides an organic light emitting display including a scan driver for sequentially supplying a scan signal to scan lines and sequentially supplying a control signal to signal control lines; a data driver for supplying a data signal to data lines to synchronize with the scan signal; and pixels at crossing region of the scan lines and the data lines. Each of the pixels extended in an $i^{th}$ (i is an integer) horizontal line of the organic light emitting display includes an organic light emitting diode; a second transistor for controlling an electric current capacity flowing from a first power source to a second power source via the organic light emitting diode; a first capacitor coupled between a gate electrode of the second transistor and an $i^{th}$ power line of a plurality of power lines or an $i^{th}$ signal control line of the signal control lines; a first transistor coupled to an $i^{th}$ scan line of the scan lines and a corresponding data line of the data lines and for turning on, when a scan signal is supplied to an $i^{th}$ scan line of the scan lines, to supply the data signal to a gate electrode of the second transistor; and a compensation unit for controlling a voltage of the gate electrode of the second transistor to correspond to a degradation of the organic light emitting diode. The compensation unit includes first and second feedback capacitors coupled in series between an anode electrode of the organic light emitting diode and the gate electrode of the second transistor and a third transistor coupled between a common node of the first and second feedback capacitors and a reset power source and for turning on when a control signal is supplied to the $i^{th}$ signal control line.

The organic light emitting display according to one embodiment of the present invention further includes a power signal supply unit for sequentially supplying a power signal to the power lines. Also, a voltage of a third power source may be supplied to the $i^{th}$ power line when the power signal is supplied to the $i^{th}$ power line, and a voltage of a fourth power source that is higher than that of the third power source may be supplied to the $i^{th}$ power line when the power signal is not supplied to the $i^{th}$ power line. Here, the voltages of the third power source and the fourth power source may be set to a voltage value so that an electric current flows in the second transistor, the electric current being higher than an electric current that flows to correspond to the data signal. In one embodiment, the scan driver is adapted to supply the control signal supplied to the $i^{th}$ signal control line to overlap with the scan signal supplied to the $i^{th}$ scan line, and to supply the control signal to the $i^{th}$ signal control line, the control signal having a wider interval than that of the scan signal. Also, the power signal supply unit may be adapted to supply the control signal supplied to the $i^{th}$ signal control line to overlap with the scan signal supplied to the $i^{th}$ scan line and to supply the control signal to the $i^{th}$ signal control line, the power signal having a wider interval than that of the scan signal. Here, the scan driver may sequentially supply a light emitting control signal to light emitting control lines.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
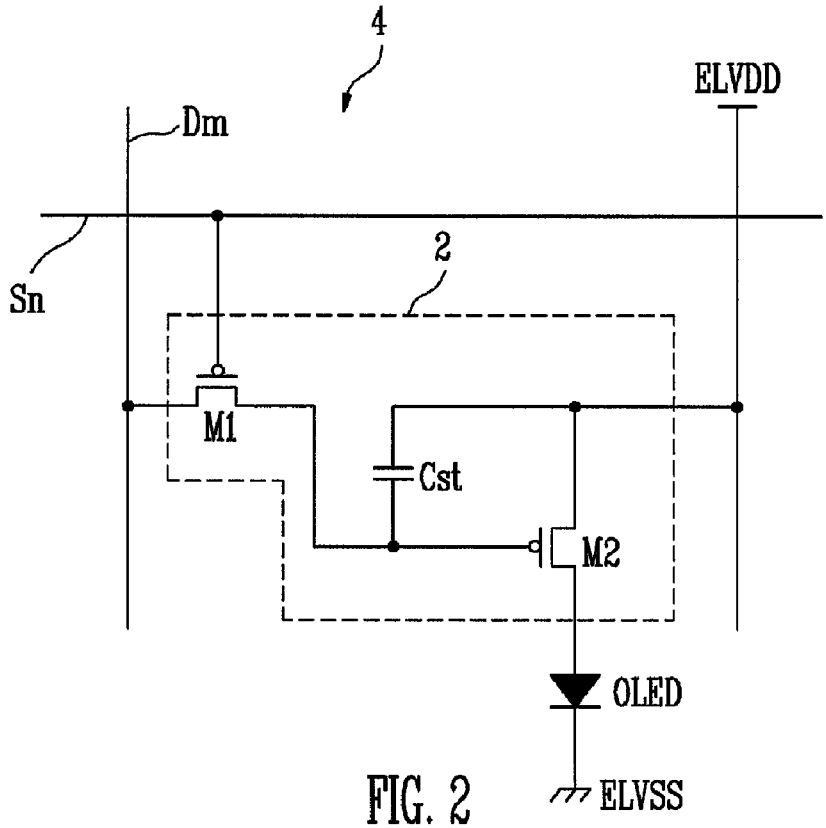
FIG. 1 (RELATED ART)
FIG. 1 is a circuit diagram schematically showing a pixel of a conventional organic light emitting display.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

Figure 2:
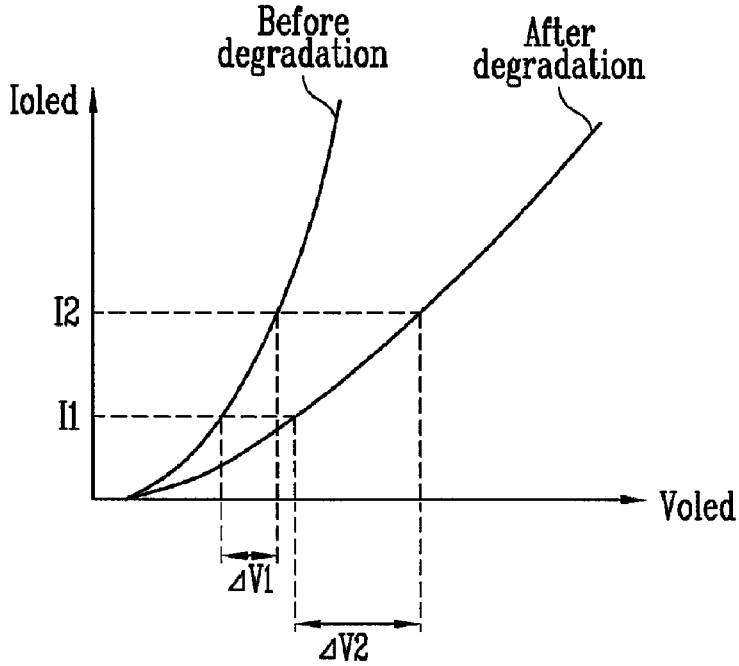
FIG. 2 is a graph illustrating the degradation characteristics of an organic light emitting diode.

FIG. 2 is a graph illustrating the degradation characteristics of an organic light emitting diode. In FIG. 2, "Ioled" represents an electric current that flows in an organic light emitting diode, and "Voled" represents a voltage applied to the organic light emitting diode.

Referring to FIG. 2, a higher voltage is applied to an organic light emitting diode that is more degraded (after degradation) to correspond to the same electric current of an organic light emitting diode that is less degraded (before degradation). And, a voltage range (or difference) of $\Delta V1$ corresponds to a certain electric current range (I1 to I2) before the organic light emitting diode is degraded. However, after the organic light emitting diode is degraded, a voltage range of $\Delta V2$ having a higher voltage range than the voltage range of $\Delta V1$ corresponds to the certain electric current range (I1 to I2). Also, resistance components of the organic light emitting diode are increased in number as the organic light emitting diode is more degraded.

Figure 3:
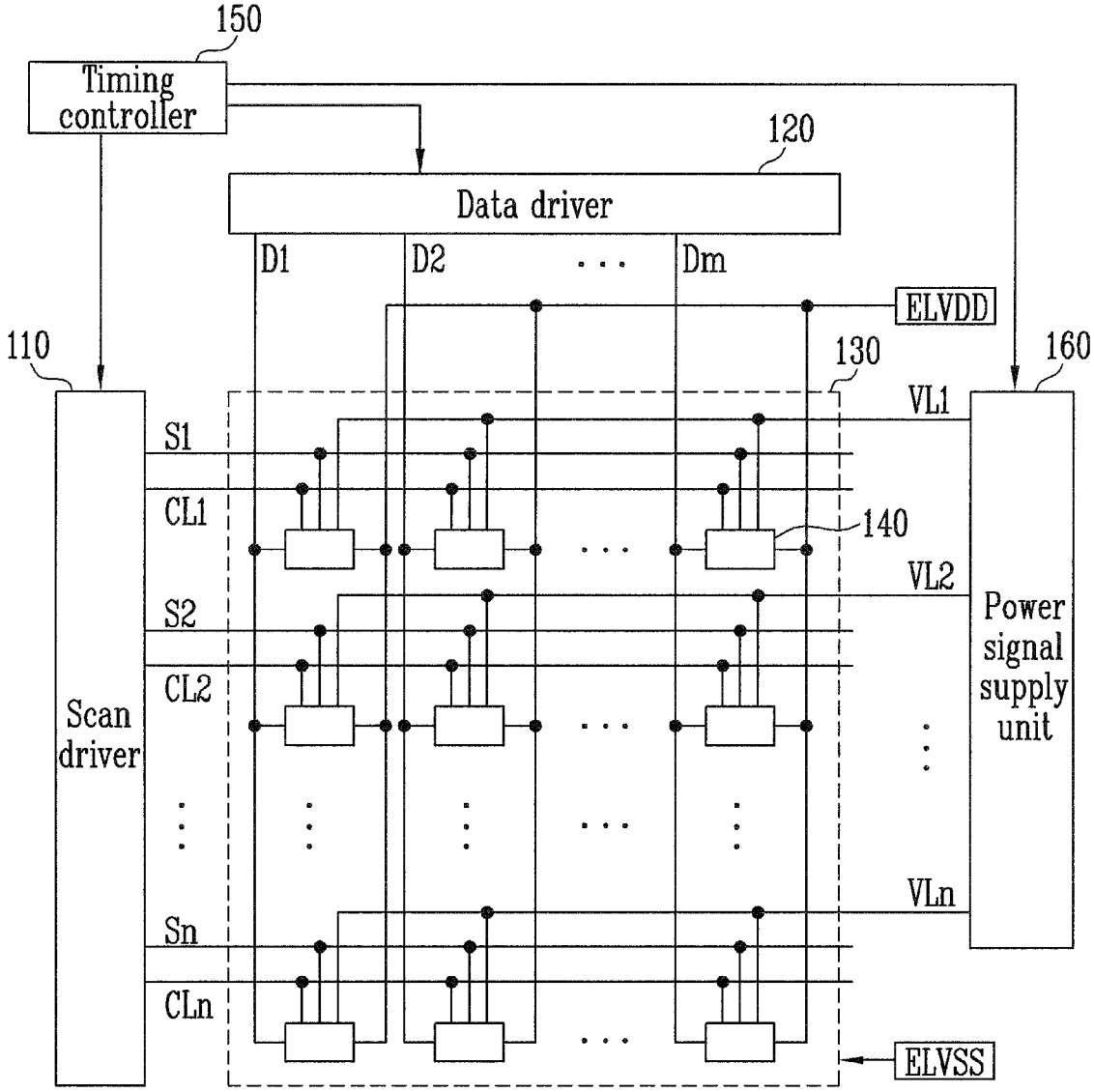
FIG. 3 is a diagram schematically showing an organic light emitting display according to one exemplary embodiment of the present invention.

FIG. 3 is a diagram schematically showing an organic light emitting display according to one exemplary embodiment of the present invention.

Referring to FIG. 3, the organic light emitting display includes a pixel unit (or display region) 130 including pixels 140 disposed at (or in) regions (or crossing regions) divided (or defined) by scan lines (S1 to Sn), control lines or signal control lines (CL1 to CLn), power lines (VL1 to VLn) and data lines (D1 to Dm); a scan driver 110 to drive the scan lines (S1 to Sn) and the control lines (CL1 to CLn); a data driver 120 to drive the data lines (D1 to Dm); a power signal supply unit 160 to drive the power lines (VL1 to VLn); a timing controller 150 to control the scan driver 110, the data driver 120 and the power signal supply unit 160.

The scan driver 110 generates a scan signal under the control of the timing controller 150, and sequentially supplies the generated scan signal to the scan lines (S1 to Sn). Here, polarity of the scan signal is set to turn on a transistor in each of the pixels 140. For example, when the transistor in each of the pixels 140 is a P-channel metal-oxide semiconductor (PMOS), the polarity of the scan signal is set to a LOW voltage. Also, the scan driver 110 generates a control signal, and sequentially supplies the generated control signal to the control lines (CL1 to CLn). Here, the polarity of the control signal is set to the same polarity as the scan signal. For example, when the scan signal is set to a LOW voltage, the control signal is also set to a LOW voltage. And, the control signal supplied to an $i^{th}$ (i is an integer) control line (CLi) is overlapped with the scan signal supplied to an $i^{th}$ scan line (Si), and is also (concurrently or simultaneously) set to have a wider interval (or width) than that of the scan signal.

The power signal supply unit 160 sequentially supplies a power signal to the power lines (VL1 to VLn). Here, the power line (VL) receiving the power signal is set to a voltage of a third power source, and the power line (VL) that does not receives the power signal is set to a voltage of a fourth power source that is higher than that of the third power source. And, the power signal supplied to the $i^{th}$ power line (VLi) is overlapped with the scan signal supplied to the $i^{th}$ scan line (Si), and is also currently (or simultaneously) set to have a wider interval (or width) than that of the scan signal. For example, the interval (or width) of the power signal may be set to have the same (or substantially the same) interval (or width) as the control signal.

The data driver 120 generates a data signal under the control of the timing controller 150, and supplies the generated data signal to the data lines (D1 to Dm) to synchronize with the scan signal.

The timing controller 150 controls the scan driver 110, the data driver 120 and the power signal supply unit 160. Also, the timing controller 150 transmits externally supplied data to the data driver 120.

The pixel unit 130 receives a power (or voltage) of a first power source (ELVDD) and a power (or voltage) of a second power source (ELVSS) from the outside of the pixel unit 130, and supplies the power of the first power source (ELVDD) and the power of the second power source (ELVSS) to each of the pixels 140. Each of the pixels 140 receiving the power of the first power source (ELVDD) and the power of the second power source (ELVSS) generates the light corresponding to the data signal.

The above-mentioned pixels 140 functions to generate the light with desired luminance by compensating for the degradation of an organic light emitting diode that is included in each of the pixels 140. For this purpose, a compensation unit to compensate for the degradation of an organic light emitting diode is installed in each of the pixels 140.

Figure 4:
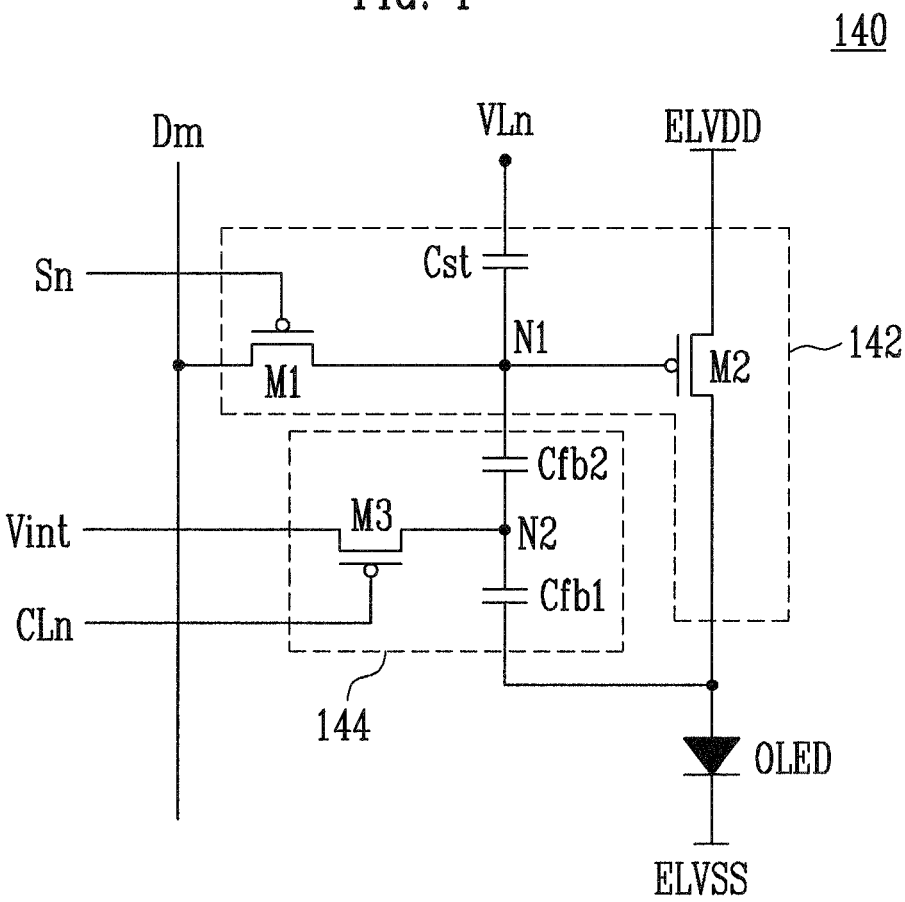
FIG. 4 is a circuit diagram schematically showing a pixel according to a first exemplary embodiment as shown in FIG. 3.

FIG. 4 is a circuit diagram schematically showing a pixel 140 according to a first exemplary embodiment as shown in FIG. 3. Here, a pixel coupled to an $n^{th}$ scan line (Sn) and an $m^{th}$ data line (Dm) is shown in FIG. 4 for convenience of the description.

Referring to FIG. 4, the pixel 140 according to the first exemplary embodiment of the present invention includes an organic light emitting diode (OLED); a pixel circuit 142 including a second transistor (M2) (i.e., a drive transistor) to supply an electric current to the organic light emitting diode (OLED); and a compensation unit 144 to compensate for the degradation of the organic light emitting diode (OLED).

An anode electrode of the organic light emitting diode (OLED) is coupled to the pixel circuit 142, and a cathode electrode is coupled to the second power source (ELVSS). Such an organic light emitting diode (OLED) generates the light with set (or predetermined) luminance to correspond to an electric current capacity supplied from the second transistor (M2). For this purpose, the first power source (ELVDD) has a higher voltage value than the second power source (ELVSS).

The pixel circuit 142 supplies an electric current to the organic light emitting diode (OLED). For this purpose, the pixel circuit 142 includes a first transistor (M1), a second transistor (M2) and a storage capacitor (Cst).

Also, in the pixel circuit 142, a gate electrode of a first transistor (M1) is coupled to a scan line (Sn), and a first electrode of the first transistor (M1) is coupled to the data line (Dm). A second electrode of the first transistor (M1) is coupled to a gate electrode (i.e., a first node (N1)) of the second transistor (M2). Such a first transistor (M1) is turned on when a scan signal is supplied to the scan line (Sn), to thus supply a data signal, supplied from the data line (Dm), to the first node (N1).

A gate electrode of the second transistor (M2) is coupled to the first node (N1), and a first electrode of the second transistor (M2) is coupled to the first power source (ELVDD). A second electrode of the second transistor (M2) is coupled to an anode electrode of the organic light emitting diode (OLED). Such a second transistor (M2) supplies an electric current to the organic light emitting diode (OLED), the electric current corresponding to a voltage applied to the first node (N1).

Also, in the pixel circuit 142, the storage capacitor (Cst) is coupled between the first node (N1) and the power line (VLn). Such a storage capacitor (Cst) is charged with a voltage corresponding to the data signal.

The compensation unit 144 controls a voltage of the first node (N1) to correspond to the degradation of the organic light emitting diode (OLED). That is, the compensation unit 144 compensates for the degradation of the organic light emitting diode (OLED) by controlling a voltage of the first node (N1) to be lowered as the organic light emitting diode (OLED) is more degraded.

For this purpose, the compensation unit 144 includes a third transistor (M3), a first feedback capacitor (Cfb1) and a second feedback capacitor (Cfb2).

The first feedback capacitor (Cfb1) and the second feedback capacitor (Cfb2) are coupled in series between the first node (N1) and the anode electrode of the organic light emitting diode (OLED).

The third transistor (M3) is disposed between a reset power source (Vint) and a second node (N2) that is a common node of the first feedback capacitor (Cfb1) and the second feedback capacitor (Cfb2). A gate electrode of the third transistor (M3) is coupled to the control line (CLn). Such a third transistor (M3) is turned on when a control signal is supplied to the control line (CLn), to thus maintain a voltage of the second node (N2) to a voltage of the reset power source (Vint). The reset power source (Vint) is used to maintain the voltage of the second node (N2) at a constant voltage, and may be set by various suitable voltage sources. For example, the reset power source (Vint) may be set to have the same (or substantially identical) power (or voltage) as that of the first power source (ELVDD).

Figure 5:
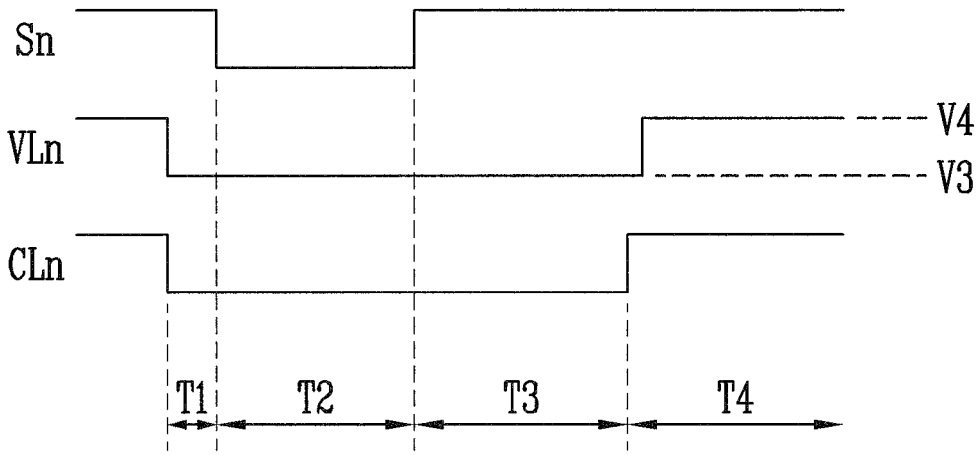
FIG. 5 is a waveform diagram showing a method for driving the pixel as shown in FIG. 4.

FIG. 5 is a waveform diagram showing a method for driving the pixel as shown in FIG. 4.

The method for driving a pixel will be described in more detail in combination with FIGS. 4 and 5. First, a power signal is supplied to a power line (VLn) and a control signal is concurrently (or simultaneously) supplied to a control line (CLn) during a first period (T1).

When the control signal is supplied to the control line (CLn), the third transistor (M3) is turned on. When the third transistor (M3) is turned on, a reset power source (Vint) is supplied to the second node (N2).

When the power signal is supplied to the power line (VLn), a voltage of the power line (VLn) drops from a voltage (V4) of the fourth power source to a voltage (V3) of the third power source. At this time, a voltage of the first node (N1) drops to correspond to the voltage drop of the power line (VLn) due to the coupling of the storage capacitor (Cst).

When the voltage of the first node (N1) drops, a first electric current is supplied from the second transistor (M2) to the organic light emitting diode (OLED). Here, the voltage (V3) of the third power source and the voltage (V4) of the fourth power source are set so that a high first electric current can flow from the second transistor (M2) to the organic light emitting diode (OLED). For example, the voltage (V3) of the third power source and the voltage (V4) of the fourth power source are set so that an electric current, which is higher than the maximum electric current that may flow in the organic light emitting diode (OLED), can flow to correspond to the data signal.

A voltage corresponding to the first electric current is applied to the organic light emitting diode (OLED) that receives the first electric current from the second transistor (M2). At this time, the first feedback capacitor (Cfb1) is charged with a voltage corresponding to the voltage difference between the voltage applied to the organic light emitting diode (OLED) and the voltage applied to the second node (N2).

During a second period (T2), a scan signal is supplied to the scan line (Sn). When the scan signal is supplied to the scan line (Sn), the first transistor (M1) is turned on. When the first transistor (M1) is turned on, a data signal supplied by the data line (Dm) is supplied to the first node (N1). At this time, the storage capacitor (Cst) is charged with a voltage corresponding to the data signal. And, the second feedback capacitor (Cfb2) is charged with a voltage corresponding to the voltage difference between the data signal and the reset power source (Vint). Here, the first feedback capacitor (Cfb1) maintains a voltage charged in the first period (T1) since the second node (N2) maintains a voltage of the reset power source (Vint) during the second period (T2).

Also, the data signal is supplied to correspond to a higher grey level (i.e., to allow a more emission electric current to flow) than grey levels to be actually expressed so as to supply an electric current corresponding to the normal grey levels, when a voltage of the power line (VLn) increases afterwards.

The supply of a scan signal to the scan line (Sn) is suspended during a third period (T3). When the supply of the scan signal is suspended, the first transistor (M1) is turned off. During this third period (T3), the first feedback capacitor (Cfb1) is continuously charged with a voltage that is applied to correspond to the first electric current supplied to the organic light emitting diode (OLED). Here, the first electric current refers to an electric current corresponding to the voltage drop of the data signal and power line (VLn).

The supply of a power signal supplied to the power line (VLn) and a control signal supplied the control line (CLn) is suspended during a fourth period (T4).

When the supply of the control signal to the control line (CLn) is suspended, the third transistor (M3) is set to be in a turned-off state. In this case, the second node (N2) is set to be in a floating state.

When the supply of the power signal to the power line (VLn) is suspended, a voltage of the power line (VLn) increases from the voltage (V3) of the third power source to the voltage (V4) of the fourth power source. At this time, a voltage of the first node (N1) also increases according to the voltage swell of the power line (VLn) because the first node (N1) is set to be in a floating state. In this case, the second transistor (M2) supplies a second electric current to the organic light emitting diode (OLED) to correspond to the voltage swell of the first node (N1), the second electric current being lower than the first electric current.

A voltage corresponding to the second electric current is applied to the organic light emitting diode (OLED) that receives the second electric current from the second transistor (M2). Here, a voltage applied to the organic light emitting diode (OLED) during the fourth period (T4) is set to a lower voltage value than the voltage as applied in the third period (T3) because the second electric current is an electric current that is lower than the first electric current.

At this time, the voltages of the second node (N2) and the first node (N1), both of which are set to be in the floating state, are changed according to the voltage applied to the organic light emitting diode (OLED). In fact, the voltage of the second node (N2) is changed as represented by the following Equation 1, and the voltage of the first node (N1) is changed as represented by the following Equation 2.

$$V_{N2}=V\text{int}-\{Cfb2\times(V\text{oled}1-V\text{oled}2)/(Cfb2+Cfb1\|Cst)\} \quad \text{Equation 1}$$

$$V_{N1}=V\text{data}-\{(Cfb1\|Cfb2)\times(V\text{oled}1-V\text{oled}2)/(Cst+(Cfb1\|Cfb2))\} \quad \text{Equation 2}$$

In the Equations 1 and 2, Voled1 represents a voltage that is applied to the organic light emitting diode (OLED) to correspond to the first electric current, Voled2 represents a voltage that is applied to the organic light emitting diode (OLED) to correspond to the second electric current, and Vdata represents a voltage corresponding to the data signal.

Referring to Equations 1 and 2, it is revealed that, when the voltage applied to the organic light emitting diode (OLED) is changed, the voltage of the first node (N1) is changed according to the capacities of the first feedback capacitor (Cfb1), the second feedback capacitor (Cfb2) and the storage capacitor (Cst). Here, when the organic light emitting diode (OLED) is degraded, a voltage value of Voled1-Voled2 is increased due to the increased in the resistance of the organic light emitting diode (OLED), which leads to the drop in the voltage of the first node (N1). That is to say, the capacity of an electric current that flows in the second transistor (M2) is increased to correspond to the same data signal when the organic light emitting diode (OLED) is degraded in the first exemplary of the present invention. Therefore, it is possible to compensate for the degradation of the organic light emitting diode (OLED).

Figure 6:
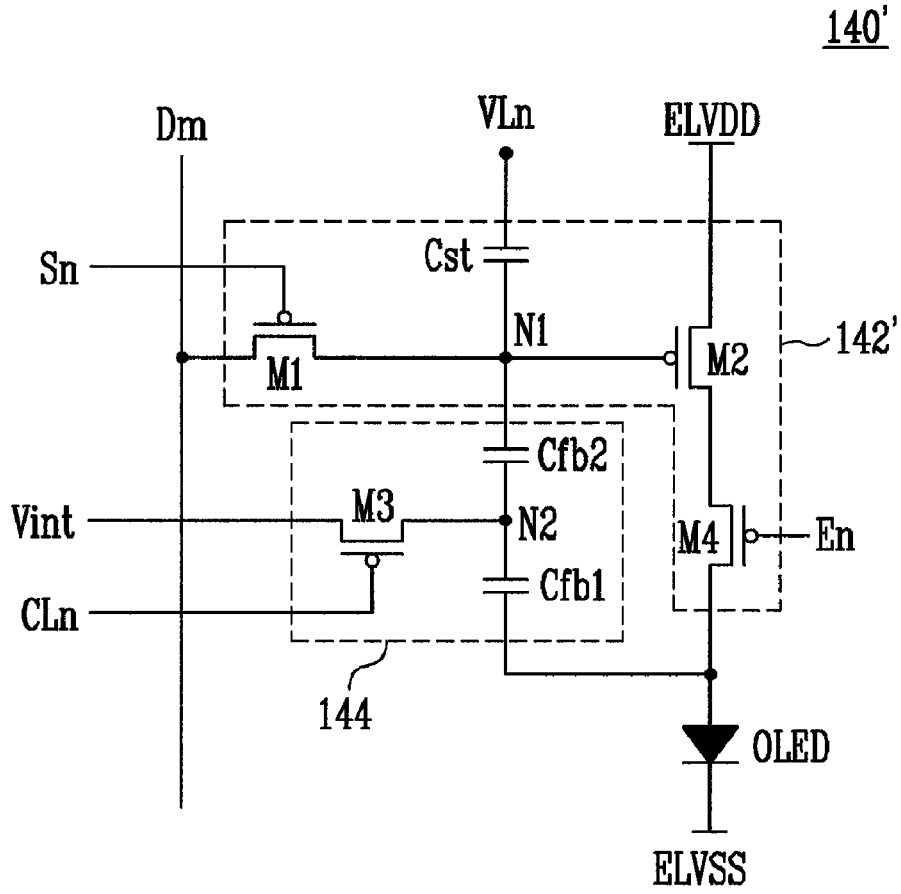
FIG. 6 is a circuit diagram schematically showing a pixel according to a second exemplary embodiment as shown in FIG. 3.

FIG. 6 is a circuit diagram schematically showing a pixel according to a second exemplary embodiment of the present invention. The detailed description of the same components as in FIG. 4 is omitted for clarity purposes. Equation 1Referring to FIG. 6, the pixel 140' according to the second exemplary embodiment of the present invention includes an organic light emitting diode (OLED); a pixel circuit 142' including a second transistor (M2) (i.e., a drive transistor) to supply an electric current to the organic light emitting diode (OLED); and a compensation unit 144 to compensate for the degradation of the organic light emitting diode (OLED).

The pixel 140' according to the second exemplary embodiment of the present invention includes a fourth transistor (M4) disposed between the second transistor (M2) and the organic light emitting diode (OLED). The fourth transistor (M4) is turned off when a light emitting control signal (HIGH voltage) is supplied to the light emitting control line (En), and is turned on in the other case. Here, the light emitting control signal is supplied from the scan driver 110. The scan driver 110 supplies a scan signal (LOW voltage) to an $i^{th}$ scan line (Si) that is overlapped with the light emitting control signal (HIGH voltage), and also concurrently (or simultaneously) supplies the light emitting control signal to an $i^{th}$ light emitting control line (Ei) such that the light emitting control signal can have a wider interval (or width) than that of the scan signal. Also, the supply of the light emitting control signal supplied to the $i^{th}$ light emitting control line (Ei) is suspended before the supply of the control signal to the $i^{th}$ control line (VLi) is suspended.

Figure 7:
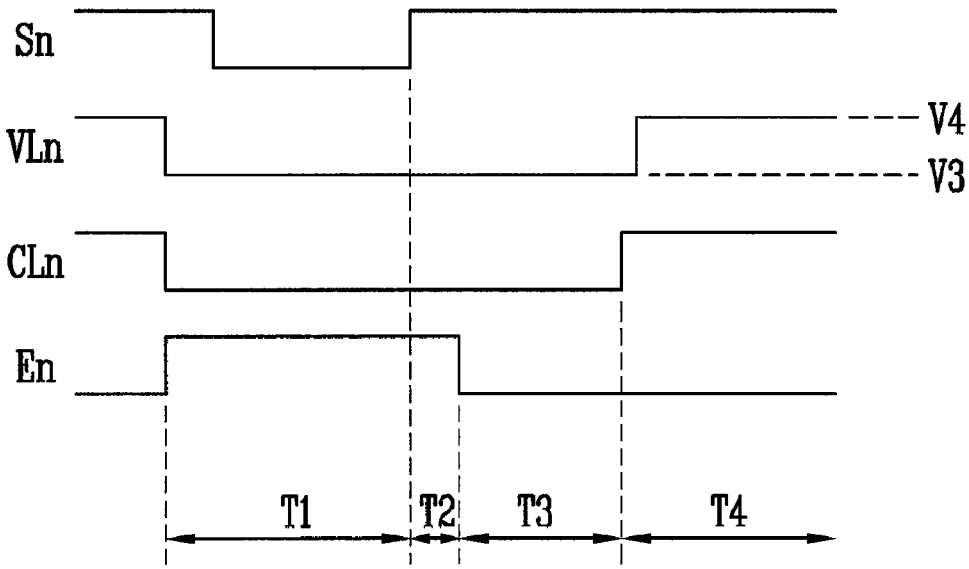
FIG. 7 is a waveform diagram showing a method for driving the pixel as shown in FIG. 6.

FIG. 7 is a waveform view showing a method for driving the pixel as shown in FIG. 6.

The method for driving a pixel will be described in more detail in combination with FIGS. 6 and 7. First, a power signal, a scan signal, a control signal and a light emitting control signal are supplied during a first period (T1).

When the control signal is supplied to a control line (CLn), the third transistor (M3) is turned on. When the third transistor (M3) is turned on, a reset power source (Vint) is supplied to the second node (N2).

When the scan signal is supplied to a scan line (Sn), the first transistor (M1) is turned on. When the first transistor (M1) is turned on, a data signal is supplied to the first node (N1). At this time, a voltage corresponding to the data signal is charged in the storage capacitor (Cst).

When the light emitting control signal is supplied to a light emitting control line (En), the fourth transistor (M4) is turned off. When the fourth transistor (M4) is turned off, an electric current is not supplied from the second transistor (M2) to the organic light emitting diode (OLED).

The supply of the scan signal to the scan line (Sn) is suspended during a second period (T2). When the supply of the scan signal to the scan line (Sn) is suspended, the first transistor (M1) is turned off.

The supply of the light emitting control signal to the light emitting control line (En) is suspended during a third period (T3). When the supply of the light emitting control signal is suspended, the fourth transistor (M4) is turned on. At this time, a first electric current is supplied from the second transistor (M2) to the organic light emitting diode (OLED) to correspond to the voltage of the first node (N1).

A voltage corresponding to the first electric current is applied to the organic light emitting diode (OLED) receiving the first electric current from the second transistor (M2). At this time, the first feedback capacitor (Cfb1) is charged with a voltage corresponding to the voltage difference between the voltage applied to the organic light emitting diode (OLED) and the voltage applied to the second node (N2).

The supply of the power signal supplied to the power line (VLn) and the control signal supplied to the control line (CLn) is suspended during a fourth period (T4).

When the supply of the control signal to the control line (CLn) is suspended, the third transistor (M3) is set to be in a turned-off state. In this case, the second node (N2) is set to be in a floating state.

When the supply of the power signal to the power line (VLn) is suspended, a voltage of the power line (VLn) increases from the voltage (V3) of the third power source to the voltage (V4) of the fourth power source. At this time, a voltage of the first node (N1) also increases according to the voltage swell of the power line (VLn) because the first node (N1) is set to be in the floating state. In this case, the second transistor (M2) supplies a second electric current to the organic light emitting diode (OLED) to correspond to the voltage of the first node (N1), the second electric current being lower than the first electric current. Here, an electric current value of the second electric current is determined according to the data signal supplied during the second period (T2).

A voltage corresponding to the second electric current is applied to the organic light emitting diode (OLED) that receives the second electric current from the second transistor (M2). Here, a voltage applied to the organic light emitting diode (OLED) during the fourth period (T4) is set to a lower voltage value than the voltage as in the third period (T3) because the second electric current is an electric current that is lower than the first electric current.

At this time, the voltages of the second node (N2) and the first node (N1), both of which are set to be in the floating state, are changed according to the voltage applied to the organic light emitting diode (OLED). In fact, the voltage of the second node (N2) is changed according to the voltage applied to the organic light emitting diode (OLED). That is, the voltage of the second node (N2) is changed as represented by the Equation 1, and the voltage of the first node (N1) is changed as represented by the Equation 2.

Here, when the organic light emitting diode (OLED) is degraded, a voltage value of Voled1-Voled2 is increased due to the increased in the resistance of the organic light emitting diode (OLED), which leads to the drop in the voltage of the first node (N1). That is, the capacity of an electric current that flows in the second transistor (M2) is increased to correspond to the same data signal when the organic light emitting diode (OLED) is degraded in the second exemplary embodiment of the present invention. Therefore, it is possible to compensate for the degradation of the organic light emitting diode (OLED).

Figure 8:
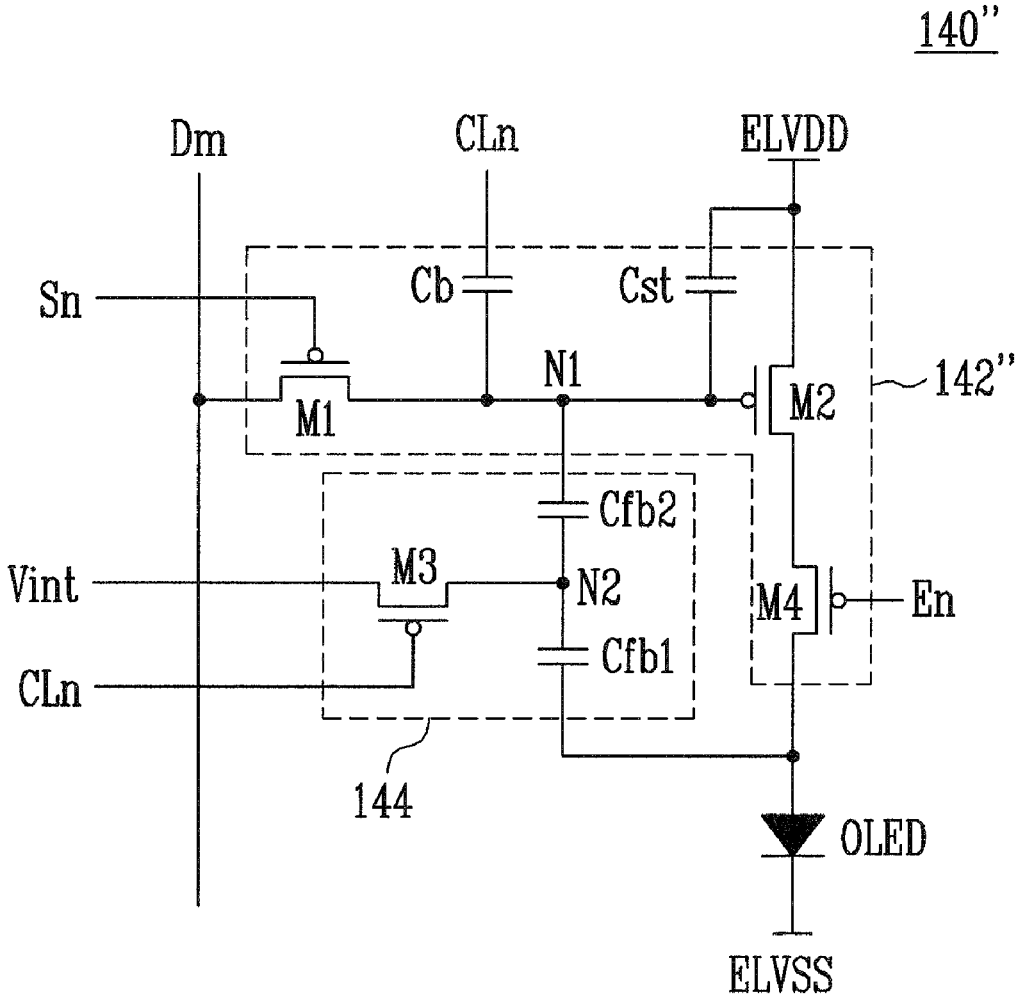
FIG. 8 is a circuit diagram schematically showing a pixel according to a third exemplary embodiment as shown in FIG. 3.

FIG. 8 is a circuit diagram schematically showing a pixel according to a third exemplary embodiment of the present invention. The detailed description of the same components as in FIG. 6 is omitted for clarity purposes.

Referring to FIG. 8, the pixel 140" according to the third exemplary embodiment of the present invention includes an organic light emitting diode (OLED); a pixel circuit 142" including a second transistor (M2) to supply an electric current to the organic light emitting diode (OLED); and a compensation unit 144 to compensate for the degradation of the organic light emitting diode (OLED).

For the pixel 140" according to the third exemplary embodiment of the present invention, a storage capacitor (Cst) is coupled between the first node (N1) and the first power source (ELVDD). Such a storage capacitor (Cst) is charged with a voltage corresponding to the data signal.

Also, a boosting capacitor (Cb) coupled between the control line (CLn) and the first node (N1) is further provided in the pixel 140" according to the third exemplary embodiment of the present invention. That is, the voltage of the first node (N1) is changed using the storage capacitor (Cst) in the case of the pixel as shown in FIGS. 4 and 6, but the voltage of the first node (N1) is changed using a separate boosting capacitor (Cb) in the case of the pixel as shown in FIG. 8.

In fact, the configuration and the driving method of the pixel 140" as show in FIG. 8, except for the boosting capacitor (Cb) of the pixel 140", are identical to (or substantially the same as) those as shown in FIG. 6. And, the boosting capacitor (Cb) of the third exemplary embodiment of the present invention is not coupled to a power line but coupled to a control line (CLn). In fact, the power signal and the control signal are supplied at the same (or substantially the same) time as shown in FIG. 7. Therefore, the pixel 140" may be driven stably although the boosting capacitor (Cb) is coupled to the control line (CLn). That is, the storage capacitor (Cst) as shown in FIGS. 4 and 6 may be also coupled to the control line (CLn). In this case, a control signal supplied to the control line (CLn) is set so that it can have a voltage difference between the third voltage (V3) and the fourth voltage (V4).

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel comprising:

an organic light emitting diode;

a second transistor for controlling an electric current capacity flowing from a first power source to a second power source via the organic light emitting diode;

a first capacitor coupled between a gate electrode of the second transistor and a power line or a control line;

a first transistor coupled to a scan line and a data line and for turning on, when a scan signal is supplied to the scan line, to supply a data signal, supplied by the data line, to the gate electrode of the second transistor; and a compensation unit for controlling a voltage of the gate electrode of the second transistor to correspond to a degradation of the organic light emitting diode;

wherein the compensation unit comprises:

first and second feedback capacitors coupled in series between an anode electrode of the organic light emitting diode and the gate electrode of the second transistor; and a third transistor coupled between a common node of the first and second feedback capacitors and a reset power source and for turning on when a control signal is supplied to the control line.

2. The pixel according to claim 1, further comprising a fourth transistor coupled between the second transistor and the organic light emitting diode and for turning off when a light emitting control signal is supplied to a light emitting control line.

3. The pixel according to claim 1, further comprising a second capacitor coupled between the gate electrode of the second transistor and the first power source.

4. The pixel according to claim 1, wherein the reset power source is set to have substantially identical voltage as that of the first power source.

5. An organic light emitting display comprising:

a scan driver for sequentially supplying a scan signal to scan lines and sequentially supplying a control signal to signal control lines;

a data driver for supplying a data signal to data lines to synchronize with the scan signal; and pixels at crossing region of the scan lines and the data lines, wherein each of the pixels extended in an $i^{th}$ horizontal line of the organic light emitting display comprises:

an organic light emitting diode;

a second transistor for controlling an electric current capacity flowing from a first power source to a second power source via the organic light emitting diode;

a first capacitor coupled between a gate electrode of the second transistor and an $i^{th}$ power line of a plurality of power lines or an $i^{th}$ signal control line of the signal control lines;

a first transistor coupled to an $i^{th}$ scan line of the scan lines and a corresponding data line of the data lines and for turning on, when a scan signal is supplied to the $i^{th}$ scan line, to supply the data signal to a gate electrode of the second transistor; and a compensation unit for controlling a voltage of the gate electrode of the second transistor to correspond to a degradation of the organic light emitting diode;

wherein i is an integer; and wherein the compensation unit comprises:

first and second feedback capacitors coupled in series between an anode electrode of the organic light emitting diode and the gate electrode of the second transistor; and a third transistor coupled between a common node of the first and second feedback capacitors and a reset power source and for turning on when a control signal is supplied to the $i^{th}$ signal control line.

6. The organic light emitting display according to claim 5, further comprising a power signal supply unit for sequentially supplying a power signal to the power lines.

7. The organic light emitting display according to claim 6, wherein a voltage of a third power source is supplied to the $i^{th}$ power line when the power signal is supplied to the $i^{th}$ power line, and a voltage of a fourth power source that is higher than that of the third power source is supplied to the $i^{th}$ power line when the power signal is not supplied to the $i^{th}$ power line.

8. The organic light emitting display according to claim 7, wherein the voltages of the third power source and the fourth power source are set to a voltage value so that an electric current flows in the second transistor, the electric current being higher than an electric current that flows to correspond to the data signal.

9. The organic light emitting display according to claim 6, wherein the power signal supply unit is adapted to supply the control signal supplied to the $i^{th}$ signal control line to overlap with the scan signal supplied to the $i^{th}$ scan line, and to supply the power signal to the $i^{th}$ power line, the power signal having a wider interval than that of the scan signal.

10. The organic light emitting display according to claim 9, wherein the power signal supplied to the $i^{th}$ power line and the control signal supplied to the $i^{th}$ signal control line are set to have substantially identical intervals.

11. The organic light emitting display according to claim 5, wherein the scan driver is adapted to supply the control signal supplied to the $i^{th}$ signal control line to overlap with the scan signal supplied to the $i^{th}$ scan line, and to supply the control signal to the $i^{th}$ signal control line, the control signal having a wider interval than that of the scan signal.

12. The organic light emitting display according to claim 11, wherein a voltage of a third power source is supplied to the $i^{th}$ signal control line when the control signal is supplied to the $i^{th}$ signal control line, and a voltage of a fourth power source that is higher than that of the third power source is supplied to the $i^{th}$ signal control line when the control signal is not supplied to the $i^{th}$ signal control line.

13. The organic light emitting display according to claim 12, wherein the voltages of the third power source and the fourth power source are set to a voltage value so that an electric current flows in the second transistor, the electric current being higher than an electric current that flows to correspond to the data signal.

14. The organic light emitting display according to claim 5, wherein the scan driver sequentially supplies a light emitting control signal to light emitting control lines.

15. The organic light emitting display according to claim 14, wherein the scan driver is adapted to supply the scan signal supplied to the $i^{th}$ scan line to overlap with the light emitting control signal supplied to an $i^{th}$ light emitting control line of the light emitting control lines, and to supply the light emitting control signal to the $i^{th}$ light emitting control line, the light emitting control signal having a wider interval than the scan signal.

16. The organic light emitting display according to claim 15, wherein a supply of the light emitting control signal supplied to the $i^{th}$ light emitting control line is suspended before a supply of the control signal supplied to the $i^{th}$ control line is suspended.

17. The organic light emitting display according to claim 14, further comprising a fourth transistor coupled between the second transistor and the organic light emitting diode and for turning off when the light emitting control signal is supplied to an $i^{th}$ light emitting control line of the light emitting control lines.

18. The organic light emitting display according to claim 5, further comprising a second capacitor coupled between the gate electrode of the second transistor and the first power source.

19. The organic light emitting display according to claim 5, wherein a voltage of the reset power source is set to have substantially identical voltage as that of the first power source.

* * * * *